US012768361B2

(12) United States Patent
Cheng et al.

(10) Patent No.: US 12,768,361 B2
(45) Date of Patent: Oct. 20, 2026

(54) FLUID PUMP

(71) Applicant: JOHNSON ELECTRIC INTERNATIONAL AG, Murten (CH)

(72) Inventors: Gequn Cheng, Shenzhen (CN); Xiaohui Wang, Shenzhen (CN); Jianwei Sun, Shenzhen (CN)

(73) Assignee: JOHNSON ELECTRIC INTERNATIONAL AG, Murten (CH)

( * ) Notice: Subject to any disclaimer, the term of this patent is extended or adjusted under 35 U.S.C. 154(b) by 0 days.

(21) Appl. No.: 19/257,660

(22) Filed: Jul. 2, 2025

(65) Prior Publication Data

US 2026/0016015 A1 Jan. 15, 2026

(30) Foreign Application Priority Data

Jul. 9, 2024 (CN) ..... 202410917849.9

(51) Int. Cl.
*F04D 13/06* (2006.01)
*F04D 1/00* (2006.01)

(52) U.S. Cl.
CPC ..... *F04D 13/0606* (2013.01); *F04D 1/00* (2013.01)

(58) Field of Classification Search
CPC ..... F04D 13/0606; F04D 1/00
USPC ..... 417/423.11
See application file for complete search history.

(56) References Cited

U.S. PATENT DOCUMENTS

| | | | | |
|---|---|---|---|---|
| 8,696,333 | B2 * | 4/2014 | Ishiguro | F04D 13/064 310/87 |
| 2019/0109516 | A1 * | 4/2019 | Bernreuther | H02K 9/227 |
| 2020/0072224 | A1 * | 3/2020 | Zou | F04D 29/406 |
| 2020/0191161 | A1 * | 6/2020 | Svarre | F04D 13/0606 |
| 2021/0408852 | A1 * | 12/2021 | Inada | F04D 25/06 |
| 2022/0416609 | A1 * | 12/2022 | Huang | H02K 5/128 |

* cited by examiner

*Primary Examiner* — Bryan M Lettman
(74) *Attorney, Agent, or Firm* — Aird & Berlis LLP

(57) ABSTRACT

A fluid pump includes a pump casing, an impeller arranged in the pump casing, and a motor for driving the impeller to rotate in the pump casing. The pump casing includes a metal sleeve arranged therein and dividing an internal space of the pump casing into a first space and a second space. The motor includes a stator received in the second space and a rotor received in the first space. The rotor is fixedly connected to the impeller and rotatably connected to a shaft. A shaft sleeve is fixedly arranged in the sleeve, and an end of the shaft is fixedly inserted into the shaft sleeve.

12 Claims, 9 Drawing Sheets

FLUID PUMP

CROSS REFERENCE TO RELATED APPLICATIONS

This non-provisional patent application claims the benefit of and priority under 35 U.S.C. § 119 (a) to patent application No. 202410917849.9 filed in The People's Republic of China on Jul. 9, 2024.

FIELD OF THE INVENTION

This application relates to pumps, specifically to fluid pumps.

BACKGROUND OF THE INVENTION

A Pump is usually connected in series within a pipeline for transporting fluids such as water, coolant, gas, etc., for example, in the thermal management system of servers in data centres, to deliver cooling fluids to dissipate heat for the servers.

Typically, a pump consists of an impeller and a motor that drives the rotation of the impeller. The motor includes a stator and a rotor that can rotate relative to the stator. The rotor is connected to the impeller to drive its rotation, thus driving fluid to flow. To avoid the fluid affecting electrical safety, the stator and rotor of the motor are separated by a sleeve. In existing structures, the sleeve is made through injection moulding, which is difficult to withstand high fluid pressure, posing a risk of cracking during use. Furthermore, the thermal conductivity of a plastic sleeve is limited, making it difficult to dissipate heat generated by the motor to outside, which can, to some extent, affect the safety of use of the motor and even the entire pump.

SUMMARY OF THE INVENTION

In view of this, a fluid pump is provided that can effectively enhance its safety of use.

For this reason, one aspect of the present invention provides a fluid pump including a pump casing, an impeller arranged in the pump casing, and a motor for driving the impeller to rotate in the pump casing. The pump casing includes a metal sleeve arranged therein and dividing an internal space of the pump casing into a first space and a second space. The motor includes a stator received in the second space and a rotor received in the first space. The rotor is fixedly connected to the impeller and rotatably connected to a shaft. A shaft sleeve is fixedly arranged in the sleeve, and an end of the shaft is fixedly inserted into the shaft sleeve.

The fluid pump may present one or several of the following aspects either solely or in combination.

Optionally, the sleeve has a cylindrical structure with an open end and a closed end, where the open end faces the impeller, a shaft seat protrudes outward from the closed end away from the open end, and the shaft sleeve is fixedly inserted into the shaft seat.

Optionally, one end of the shaft sleeve facing the impeller extends beyond the shaft seat.

Optionally, a positioning ring extends radially outward from the end of the shaft sleeve to axially abut against an inner surface of the closed end of the sleeve.

Optionally, the shaft sleeve is fixed to the shaft seat through a tight fit, and the shaft is fixed to the shaft sleeve through a tight fit.

Optionally, the pump casing includes an inner casing and an outer casing spaced apart in a radial direction, and a first cover and a second cover respectively connected to both axial ends of the outer casing, the inner casing encircles the sleeve, the first space is defined between the sleeve and the first cover, and the second space is defined between the inner casing, the outer casing, and the second cover.

Optionally, a through hole is defined in a bottom side of the inner casing, the shaft seat partially passes through the through hole and extends into the second space. Optionally, the shaft seat and the through hole have a tight fit.

Optionally, the stator includes a core with a plurality of pole portions, coils wound around the pole portions, and a circuit board electrically connected to the coils, the shaft seat is closer to the circuit board than the bottom side of the inner casing.

Optionally, the stator includes a core with a plurality of pole portions, coils wound around the pole portions, and a circuit board electrically connected to the coils, the core encircles the inner casing, and the inner casing defines a plurality of openings respectively aligning with the pole portions, allowing free ends of the pole portions to be embedded into the corresponding openings.

Optionally, the sleeve is a stainless steel sleeve.

Optionally, the shaft sleeve is a metal shaft sleeve.

Optionally, the rotor of the motor includes a core, permanent magnets, and a rotor shell integrally encapsulating the core and the permanent magnets, the rotor shell is integrally connected to the impeller.

Optionally, two bearings are connected between the shaft and the rotor shell.

Optionally, the bearings are integrally fixed within the rotor shell by an injection moulding process of the rotor shell.

Compared with existing technology, the fluid pump provided by this application separates the stator from the rotor through a sleeve, preventing fluid erosion of the stator, which would affect electrical safety. A shaft sleeve is fixedly arranged inside the sleeve, and a shaft is fixedly inserted into the shaft sleeve, which allows for a greater contact area between the shaft and the shaft sleeve, effectively enhancing the stability of the assembled shaft and avoiding rotor wobble. In addition, the sleeve is made of metal materials, which can withstand the impact of high-pressure fluids even if the sleeve is thin, and has a high thermal conductivity efficiency, which helps to improve the safety and efficiency of the motor and the fluid pump.

DETAILED DESCRIPTION OF THE PREFERRED EMBODIMENTS

Figure 1:
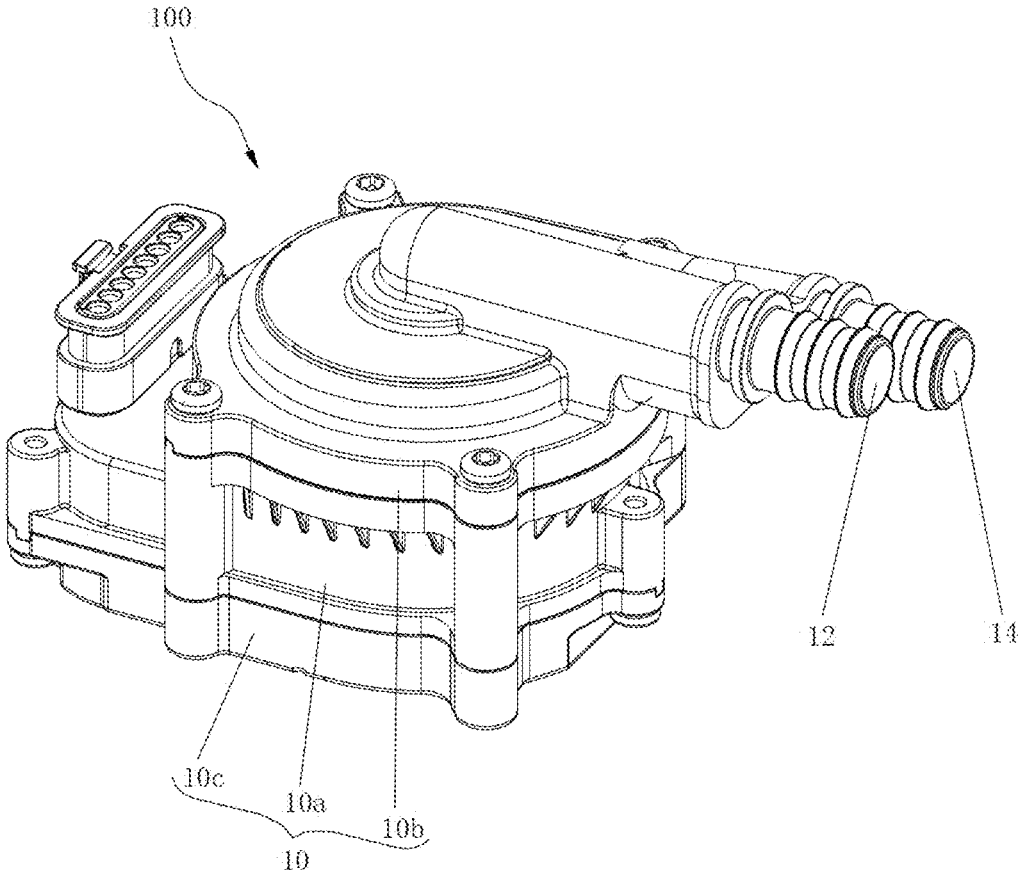
FIG. 1 is a perspective view of a fluid pump in one embodiment of this application.
Figure 2:
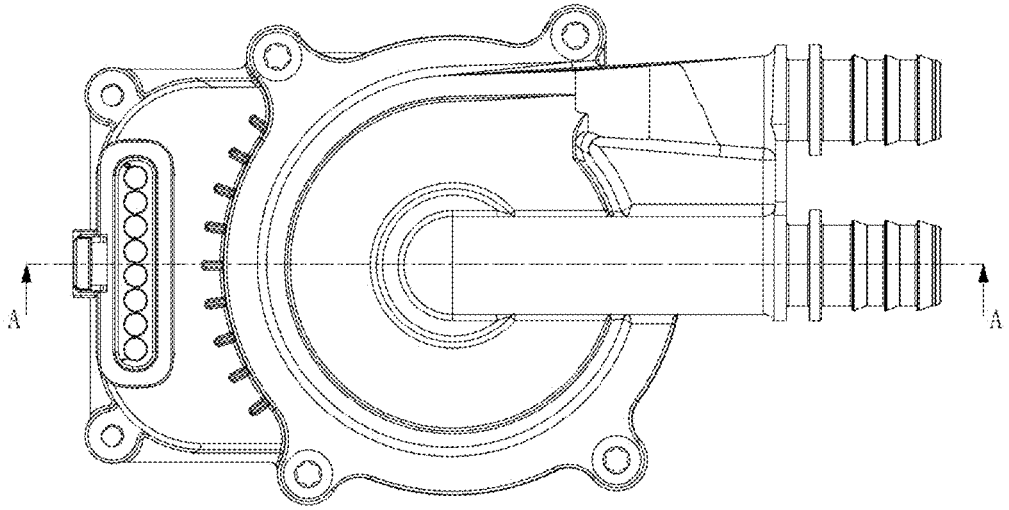
FIG. 2 is a top view of the fluid pump of FIG. 1.

In order to facilitate the understanding of the present application, a more comprehensive description of the application is provided below with reference to the relevant drawings. One or more embodiments of the present application are given in the accompanying drawings illustratively, so as to make the understanding of the technical solution disclosed in the present application more accurate and thorough. It should be understood, however, that the present application may be realized in a number of different forms and is not limited to the embodiments described below.

The same or similar numbers in the drawings of the present application correspond to the same or similar parts. In the description of the present application, it is understood that if the terms "upper", "lower", "left", "right", etc., indicate an orientation or positional relationship based on the orientation or positional relationship shown in the drawings. It is only for the convenience of describing the present application and simplifying the description, and does not indicate or imply that the device or element referred to must have a particular orientation, be constructed and operated in a particular orientation. Therefore, the terms describing the positional relationship in the drawings are for illustrative purposes only and cannot be construed as limiting the present application. For those of ordinary skill in the art, the specific meaning of the above terms can be understood on a case-by-case basis.

In addition, if there are descriptions involving "first", "second", etc., in the embodiments of the present application, the descriptions of "first", "second", etc., are only for descriptive purposes and cannot be construed as indicating or implying their relative importance or implying the number of technical features indicated. Thus, the features that are defined as "first" and "second" may explicitly or implicitly include at least one of these features. In addition, if the words "and/or" or "and/or" appear in the whole text, the meaning includes three parallel options, taking "A and/or B" as an example, including the A plan, or the B plan, or the plan A and B meet at the same time.

In addition, the technical solutions between the various embodiments may be combined with each other, but only on the basis that they can be realized by a person skilled in the art. When the combination of technical solutions contradicts or cannot be realized, it shall be deemed that the combination of such technical solutions does not exist and is not within the scope of protection claimed in the present application.

The present application provides a fluid pump for driving fluids, such as water, coolant, etc., to flow in a pipeline. The fluid pump can be applied in thermal management systems of batteries, servers, etc., to quickly dissipate heat through the circulation of fluids. FIGS. 1-6 show an embodiment of the fluid pump of the present application. The fluid pump 100 includes a pump casing 10, an impeller 20 arranged in the pump casing 10 and a motor 30 that drives the impeller 20 to rotate in the pump casing 10.

Figure 6:
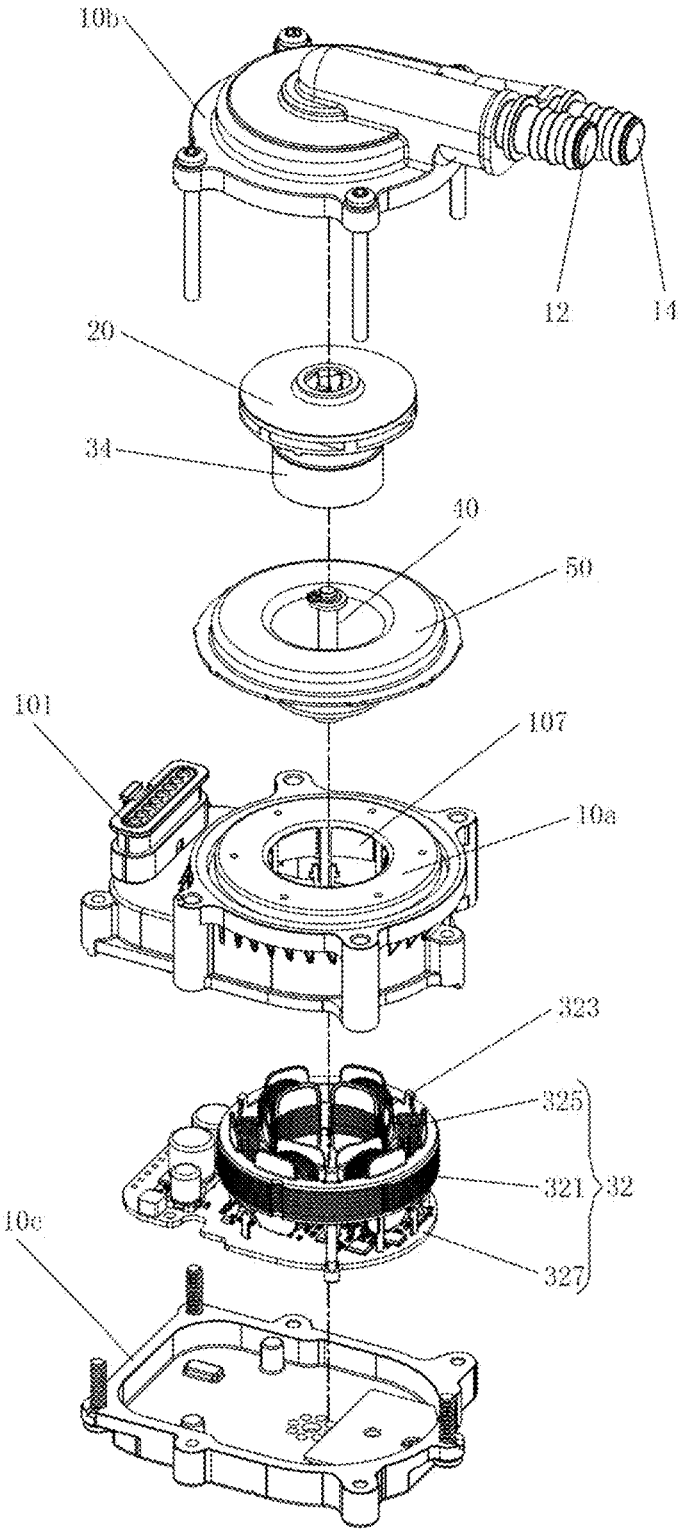
FIG. 6 is an exploded view of the fluid pump of FIG. 1.

As shown in FIGS. 1 and 6, the pump casing 10 includes a pump casing body 10*a*, and a first cover 10*b* and a second cover 10*c* respectively arranged at both ends of the pump casing body 10*a*.

Figure 3:
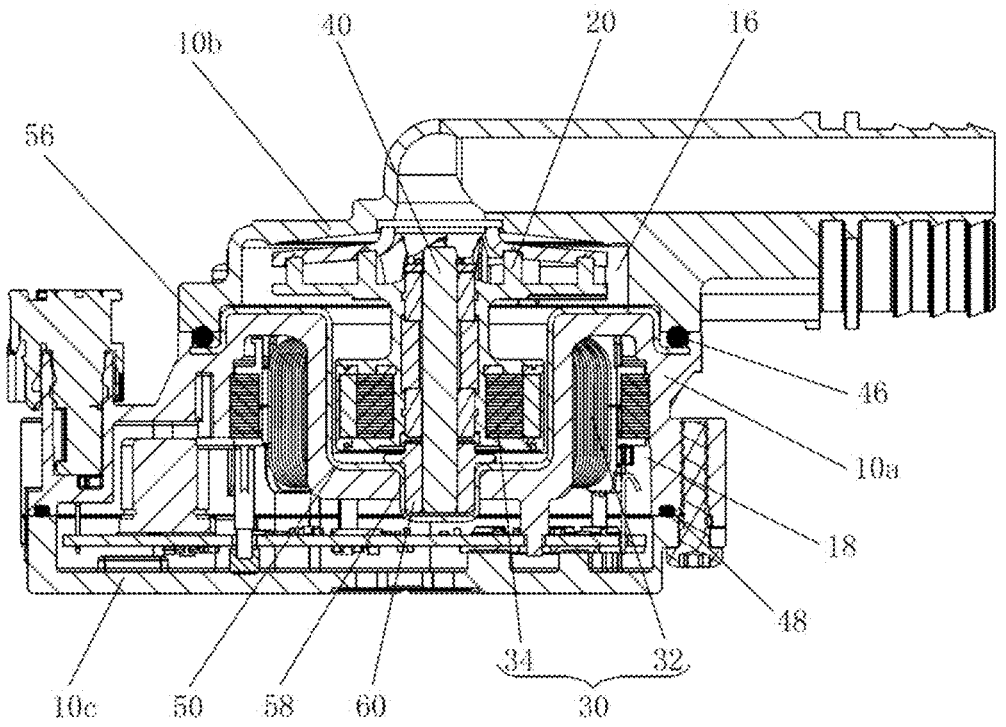
FIG. 3 is a cross-sectional view of the fluid pump of FIG. 2, take along the line A-A thereof.
Figure 4:
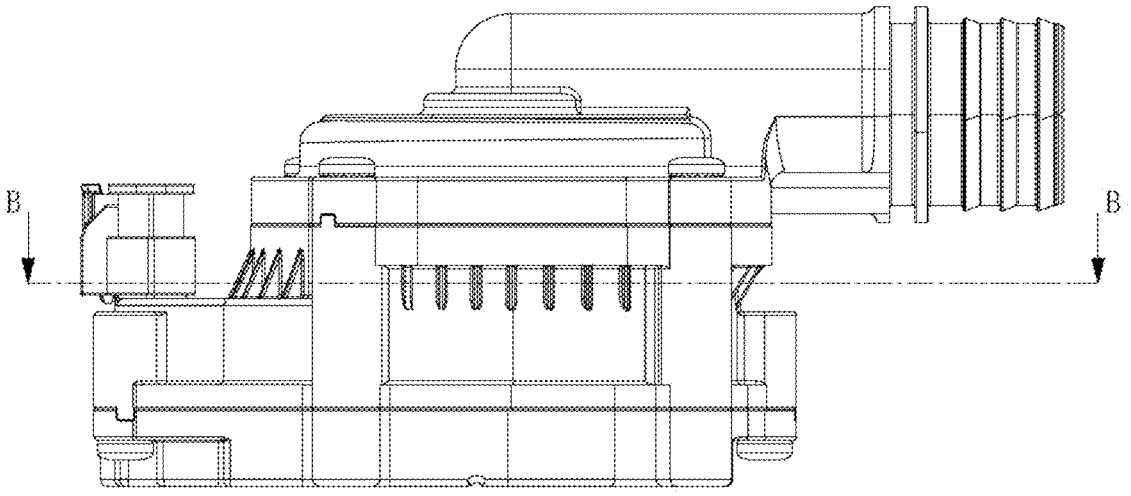
FIG. 4 is a side view of the fluid pump of FIG. 1.
Figure 5:
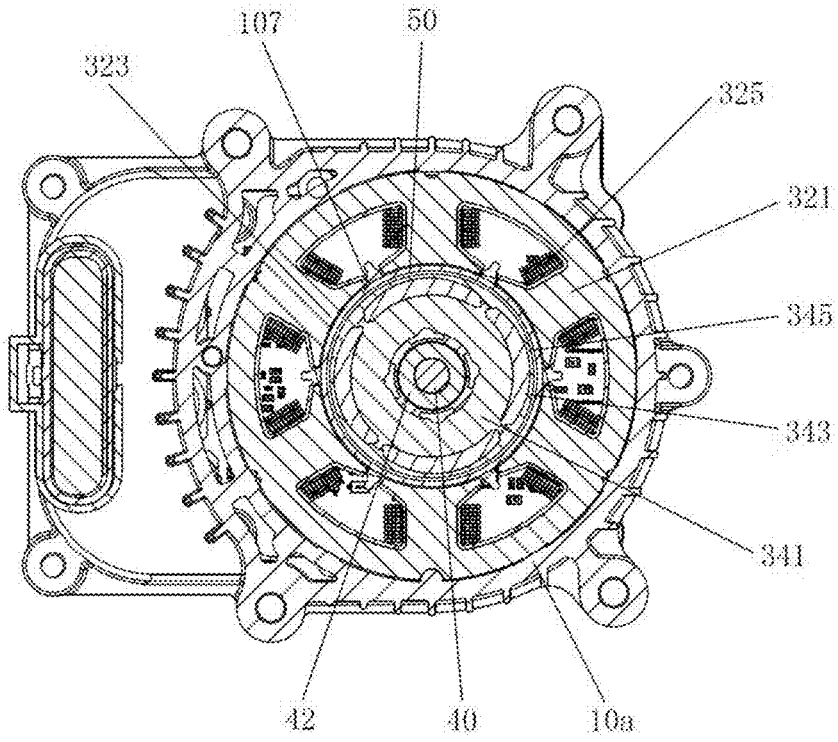
FIG. 5 is a cross-sectional view of the fluid pump of FIG. 4, take along the line B-B thereof.

As shown in FIG. 3, the impeller 20 is arranged between the pump casing body 10*a* and the first cover 10*b*. The first cover 10*b* has an inlet 12 and an outlet 14 corresponding to the impeller 20, for connecting to external pipelines, forming a flow passage for the fluid. After the fluid enters the pump casing 10 through the inlet 12, it is accelerated and pressurized by the rotating impeller 20 and then is discharged out through the outlet 14. In the illustrated embodiment, the inlet 12 extends radially along the first cover 10*b* to above the impeller 20, while the outlet 14 extends tangentially along an outer peripheral surface of the first cover 10*b*. The inlet 12 and the outlet 14 are arranged to be substantially parallel. In other embodiments, the position, direction, quantity, etc. of the inlet 12 and outlet 14 can be adjusted as needed. For example, the inlet 12 and outlet 14 can be arranged to be perpendicular to each other or inclined at a certain angle.

Figure 7:
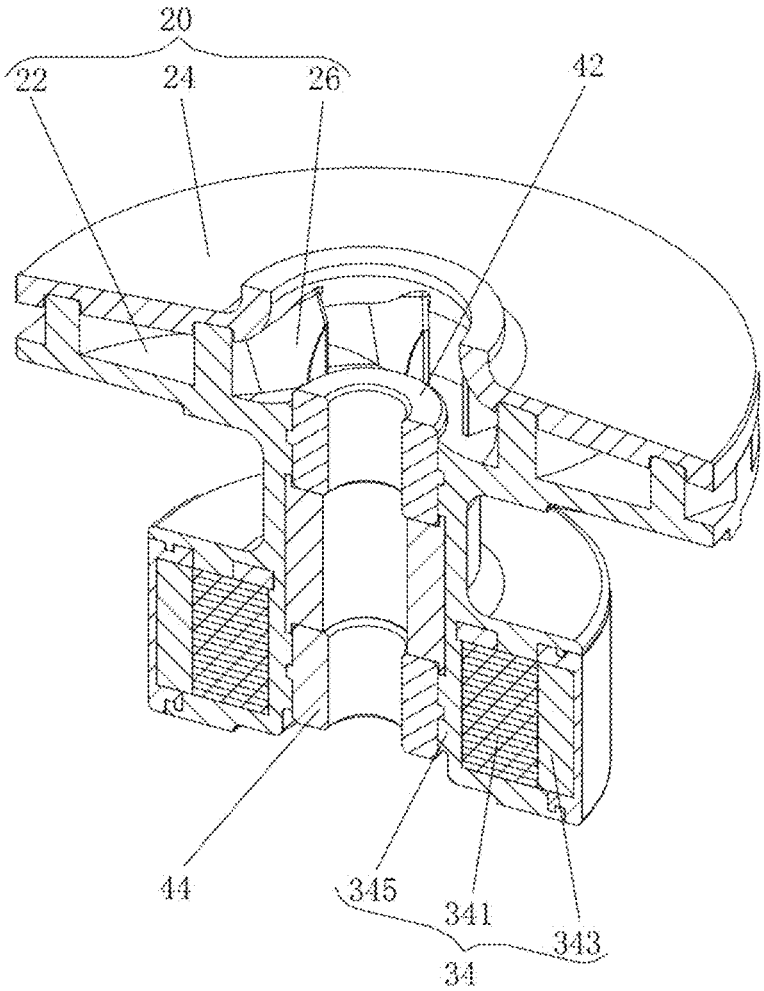
FIG. 7 is a cross-sectional view of an impeller and a rotor of the fluid pump of FIG. 6.
Figure 8:
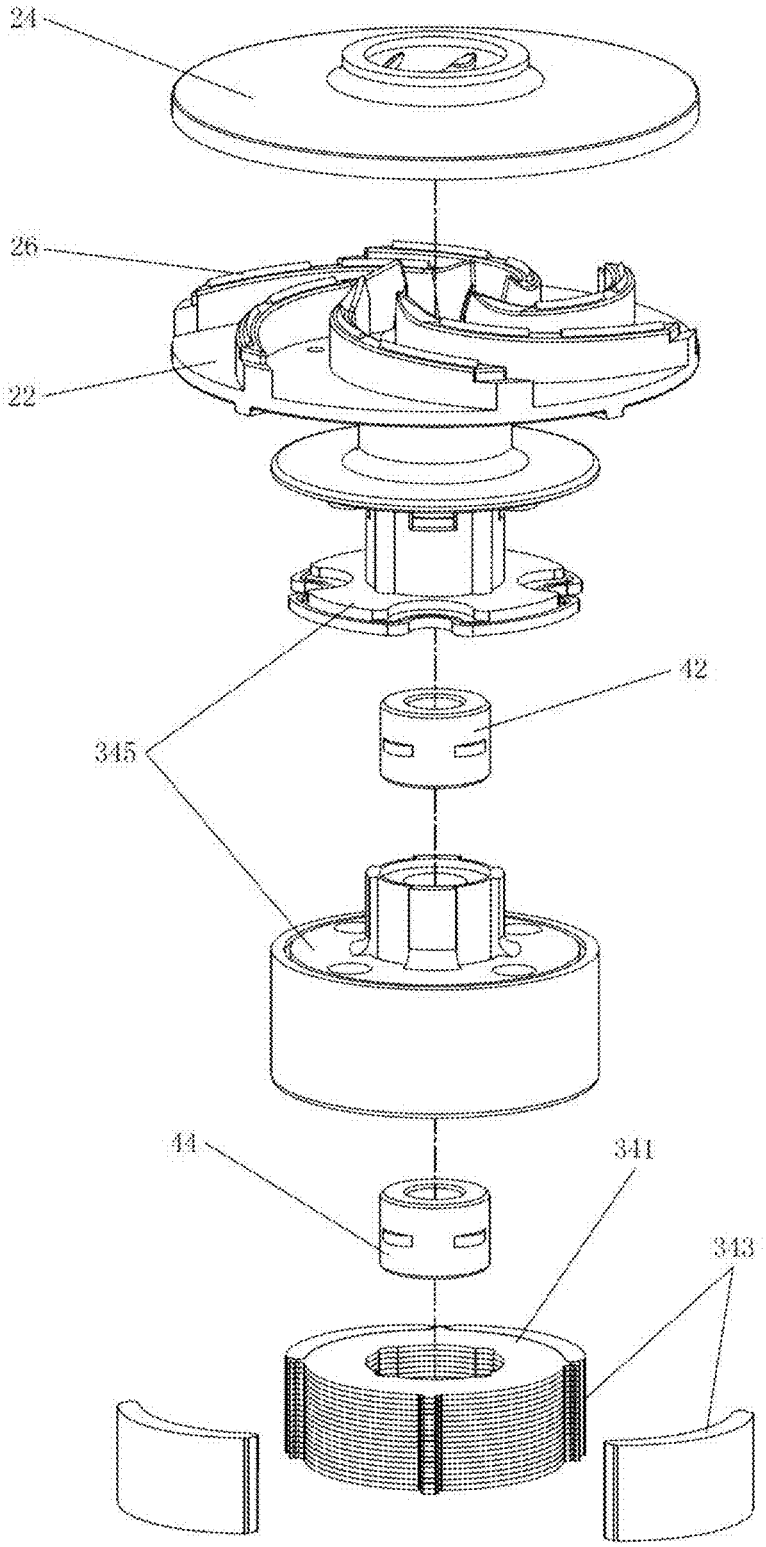
FIG. 8 is a further exploded view of the impeller and rotor.

Please also refer to FIGS. 7 and 8, the impeller 20 has an overall disc-like structure, with a diameter slightly smaller than an inner diameter of the first cover 10*b*, forming a small radial gap between the impeller 20 and the first cover 10*b* after assembly, allowing the impeller 20 to rotate freely within the first cover 10*b* under the drive of the motor 30. Specifically, the impeller 20 includes a base plate 22 and a cover plate 24 that are spaced apart, and a plurality of blades 26 arranged between the base plate 22 and the cover plate 24. Preferably, the blades 26 are integrally injection moulded with the base plate 22, and the cover plate 24 is connected to the base plate 22 or the blades 26 through latches or other means. In some embodiments, the cover plate 24 and the base plate 22 can also be connected through ultrasonic welding, bonding, and other methods. In some embodiments, the blades 26 and the cover plate 24 can also be a single integrated structure, alternatively, the impeller 20 can be a single integral structure overall.

As shown in FIGS. 3 and 6, the motor 30 is preferably an inner rotor motor, which includes a stator 32 and a rotor 34 that is rotatably arranged at the centre of the stator 32. The rotor 34 is positioned between the pump casing body 10*a* and the first cover 10*b* and is fixedly connected to the impeller 20. The stator 32 is positioned between the pump casing body 10*a* and the second cover 10*c* and is fixedly connected to the pump casing 10.

As shown in FIG. 6, the stator 32 includes a core 321 made up of several stacked silicon steel sheets. The core 321 is overall annular in shape and extends inward radially to form a plurality of pole portions 323, which are evenly spaced circumferentially. A tooth slot is defined between each two adjacent pole portions 323. Coils 325 are wound around the pole portions 323, and the coils 325 are electrically connected to a circuit board 327 via pins. In a specific embodiment, the stator 32 can be fixed in the pump casing body 10*a*, the pump casing body can be considered as a stator shell. Preferably, the pump casing body 10*a* is provided with a plug socket 101 for connecting the circuit board 327 with an external power source, supplying power to the coils 325.

As shown in FIGS. 7 and 8, the rotor 34 includes a core 341, permanent magnets 343, and a rotor shell 345 that encases both the core 341 and the permanent magnets 343. The core 341 can be made up of several stacked silicon steel sheets, and the permanent magnets 343 are affixed to an outer peripheral surface of the core 341, cooperatively forming a surface-mounted permanent magnet motor (SPM motor). In some embodiments, assembly holes can also be provided in the core 341 for inserting the permanent magnets 343, collectively forming an interior permanent magnet motor (IPM motor). The rotor shell 345 is preferably a one-piece structure. During manufacturing, the core 341 and the permanent magnets 343 can be assembled and placed into a mould, followed by injection moulding of the rotor shell 345, resulting in the rotor 34 being an integral structure, which simplifies the subsequent assembly process.

When the motor 30 starts, an external power source provides current to the coils 325 via the circuit board 327. The circuit board 327 is equipped with sensing and control circuits, etc., which control the direction and magnitude of the current in the coils 325 based on the position of the rotor 34, allowing the stator 32 to generate a periodically varying rotating magnetic field. The magnetic field interacts with a magnetic field established by the permanent magnets 343 of the rotor 34, pushing the rotor 34 to rotate continuously, thereby driving the impeller 20 connected to it to rotate.

In some embodiments, as shown in FIGS. 7 and 8, the rotor shell 345 is integrally injection moulded with the base plate 22 and blades 26 of the impeller 20, which allows the impeller 20 and rotor 34 to always remain connected and coaxial, facilitating the synchronous rotation of the impeller 20 and rotor 34, thereby enhancing the stability of their rotation. Specifically, a shaft hole is defined at the centre of the rotor shell 345 for a shaft 40 to pass through. Bearings are provided between the shaft 40 and rotor shell 345, preferably two bearings: a first bearing 42 and a second bearing 44. The first bearing 42 corresponds to the position of the impeller 20, and the second bearing 44 corresponds to the position of the rotor 34. The first bearing 42 and second bearing 44 can be ball bearings, sliding bearings, etc., and are preferably integrally fixed within the rotor shell 345 during the injection moulding process.

As shown in FIG. 3, a sleeve 50 is installed in the pump casing 10. The sleeve 50 is made of metal materials such as stainless steel and has an overall cylindrical structure with an open end 52 and a closed end 54. The open end 52 faces the impeller 20, while the closed end 54 is positioned away from the impeller 20. The sleeve 50 divides an internal space of the pump casing 10 into two relatively independent spaces: a first space 16 and a second space 18. The first space 16 is defined between the sleeve 50 and the first cover 10*b*, for receiving the rotor 34 of motor 30 and the impeller 20. The second space 18 is defined between the sleeve 50, the pump casing body 10*a*, and the second cover 10*c*, for receiving the stator 32 of motor 30. By providing the sleeve 50, the stator 32 is separated from the rotor 34 and the impeller 20, ensuring the fluid flows only in the first space 16, which effectively prevents fluid erosion of the stator 32 in the second space 18, thereby ensuring electrical safety.

In this application, the sleeve 50 is made of metal materials such as stainless steel, which has high strength and can effectively withstand the impact of high-pressure fluids, posing no risk of breakage even after long-term use. Additionally, due to the sufficient strength of the sleeve 50, its thickness can be appropriately reduced compared to plastic components, which is conducive to further decreasing an air gap between the stator 32 and rotor 34, thereby improving the efficiency of motor 30. Furthermore, the sleeve 50 has good thermal conductivity, which can effectively transfer heat generated by electronic devices in the second space 18, such as the coils 325 of the stator 32 and the circuit board 327 during operation, to the fluid in the first space 16. The heat is then rapidly dissipated outward through the fluid's flow, preventing heat accumulation in the second space 18 and ensuring the safe operation of motor 30.

Figure 11:
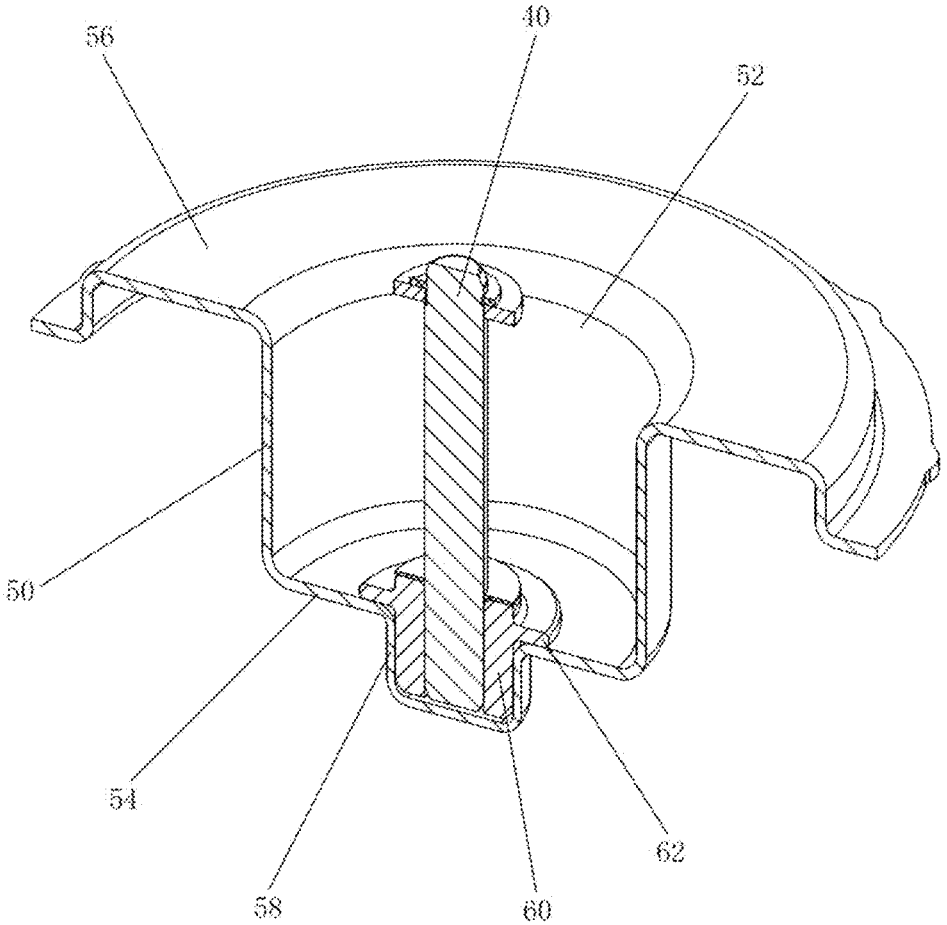
FIG. 11 is a cross-sectional view of a sleeve and a shaft of the fluid pump of FIG. 6.
Figure 12:
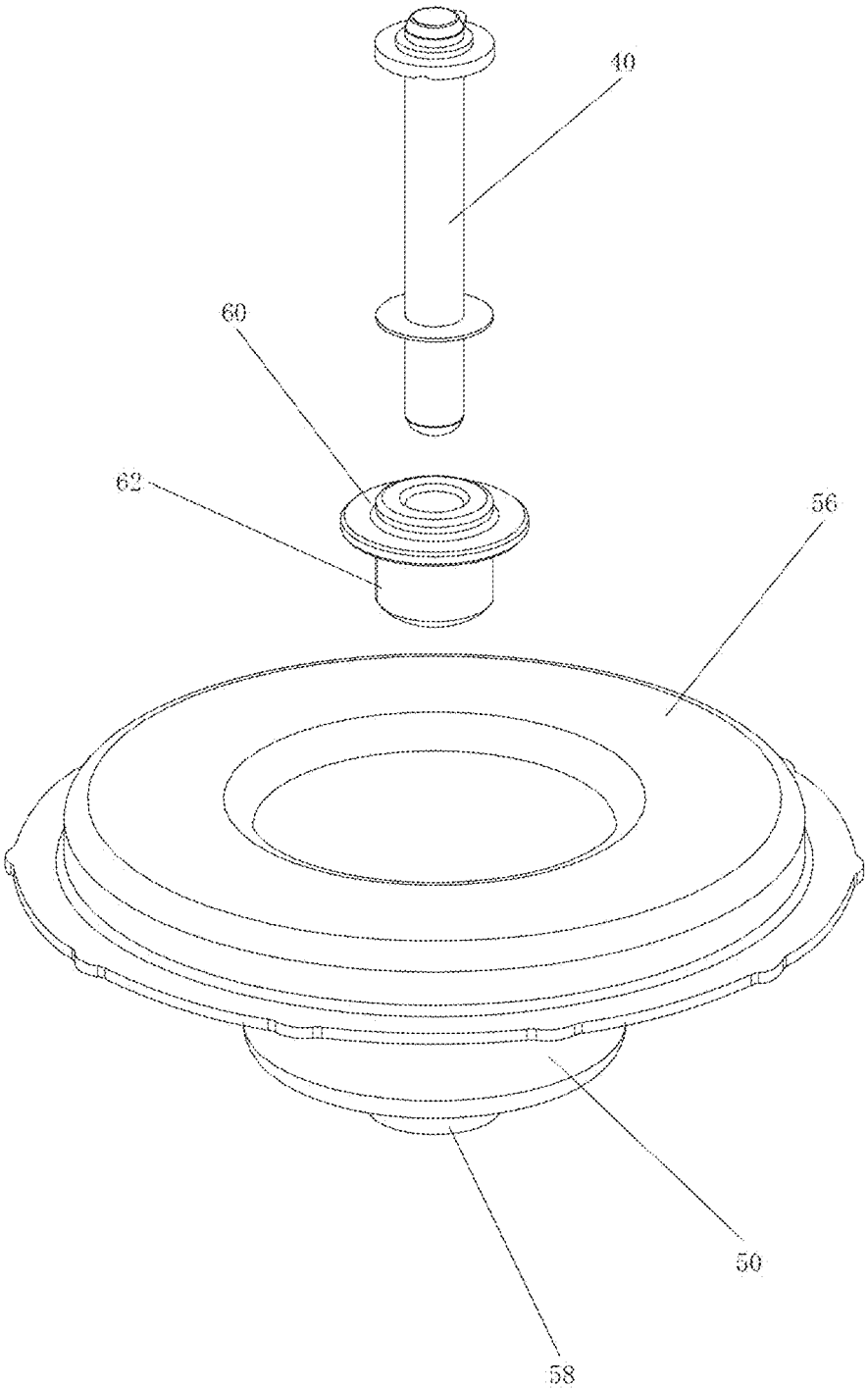
FIG. 12 is a further expolded view of the sleeve and shaft.

Please also refer to FIGS. 11 and 12, a shaft seat 58 protrudes outward from a centre of the closed end 54 of the sleeve 50, within which a shaft sleeve 60 is installed. The shaft sleeve 60 can be made of metal materials, with an outer diameter slightly greater than an inner diameter of the shaft seat 58, and the two are preferably fixed together with a tight fit, preventing the shaft sleeve 60 from rotating within the shaft seat 58. In some embodiments, an outer wall of the shaft sleeve 60 and an inner wall of the shaft seat 58 may also have key grooves and keys respectively, fixing the shaft sleeve 60 circumferentially by engaging of the key grooves and keys, thus preventing the shaft sleeve 60 from rotating within the shaft seat 58. It should be understood that the shaft sleeve 60 can also be secured in the shaft seat 58 of the sleeve 50 by other means, such as welding, bonding, etc., without being limited to the specific embodiments.

In this embodiment, an axial height of the shaft sleeve 60 is greater than the depth of the shaft seat 58, allowing one end (the upper end as shown in FIG. 11) of the shaft sleeve 60 to extend beyond the shaft seat 58 once assembled. Preferably, a positioning ring 62 extends radially outward from the upper end of the shaft sleeve 58. An outer diameter of the shaft sleeve 58 is greater than the inner diameter of the shaft seat 58 but less than an inner diameter of the sleeve 50. After assembly, a bottom surface of the positioning ring 62 abuts against an inner surface of the closed end 54 of the sleeve 50, which can position the shaft sleeve 60 axially, making the shaft sleeve 60 more stably positioned in the shaft seat 58 of the sleeve 50. It should be understood that the positioning ring 62 can also be fixed to the inner surface of the sleeve 50 by welding, bonding, etc.

The shaft 40 is pivotally connected to the rotor 34 and the impeller 20, with one end (the bottom end as shown in FIGS. 3 and 11) extending beyond the rotor 34 and inserted into the shaft sleeve 60. An outer diameter of the shaft 40 can be slightly greater than an inner diameter of the shaft sleeve 60, and the two are preferably fixed together with a tight fit, so that the shaft 40 cannot rotate within the shaft sleeve 60. In some embodiments, an outer surface of the shaft 40 and an inner surface of the shaft sleeve 60 can also be provided with key grooves and keys respectively, which fix the shaft 40 in the circumferential direction, preventing the shaft 40 from rotating within the shaft sleeve 60. It should be understood that the shaft 40 can also be fixed to the shaft sleeve 60 by other means, such as welding, bonding, etc., and is not limited to specific embodiments.

Compared to directly inserting the shaft 40 into the shaft seat 58 of the sleeve 50, the shaft 40 fits with the shaft sleeve 60, and the shaft sleeve 60 fits with the sleeve 50, allowing for a larger contact area between them. In other words, by introducing an intermediate element, i.e. the shaft sleeve 60, the shaft 40 can have a larger contact surface during installation and fixing, effectively enhancing the stability of the assembled shaft 40. During the rotation of the rotor 34 and impeller 20, even if there are uneven forces applied circumferentially, the shaft 40 can maintain a co-axial state with the rotor 34 and impeller 20 without generating wobble, ensuring the stability of the rotation of the rotor 34 and impeller 20, reducing wear and noise generation, and extending the service life of the fluid pump 100.

Figure 9:
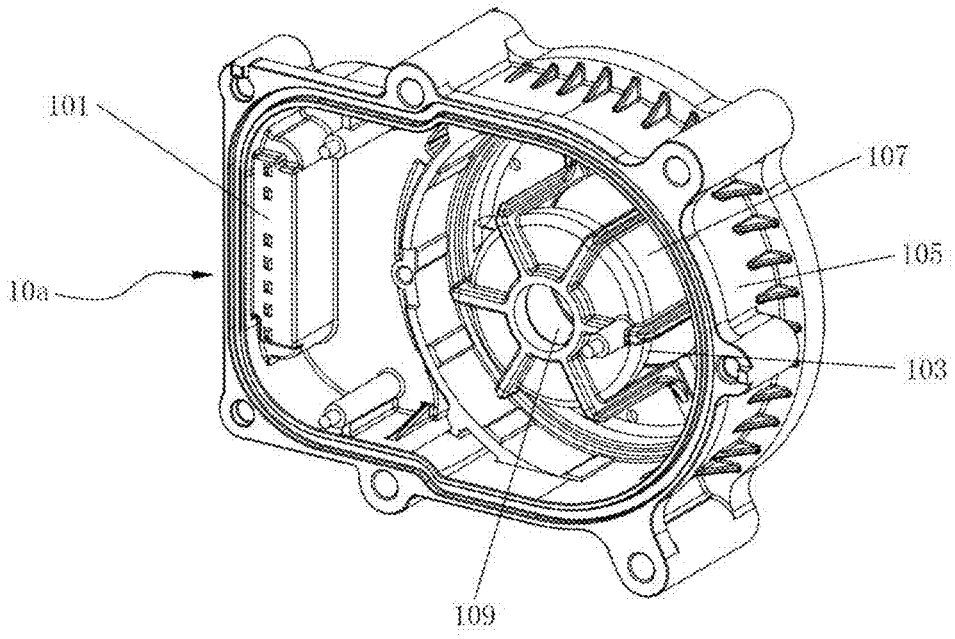
FIG. 9 is another aspect view of a pump casing body of the fluid pump of FIG. 6.
Figure 10:
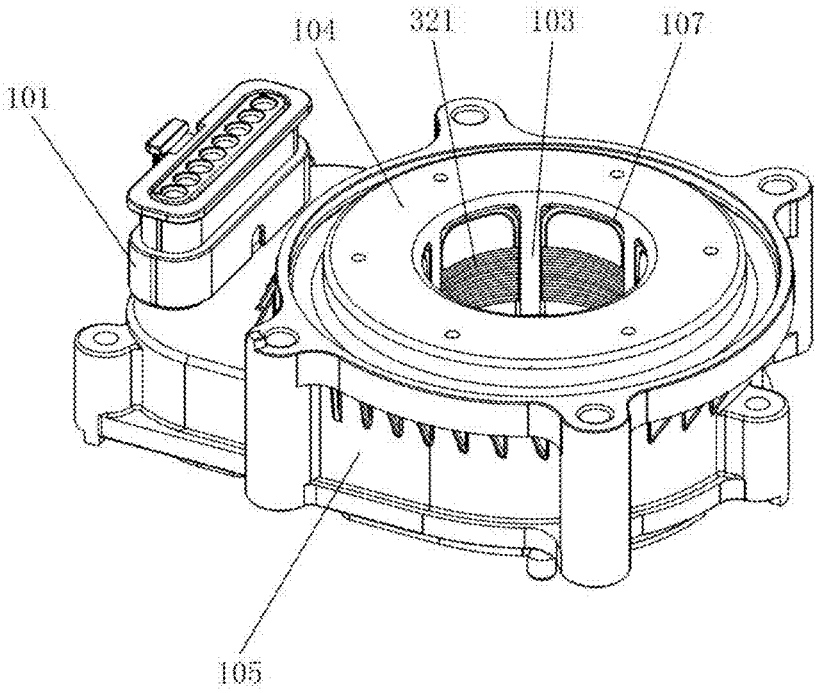
FIG. 10 is an assembled view of the pump casing body and a stator.

As shown in FIGS. 6 and 9, the pump casing body 10*a* includes an inner casing 103 and an outer casing 105, where both ends of the outer casing 105 are fixedly connected to the first cover 10*b* and the second cover 10*c*, respectively. The inner casing 103 is axially spaced from the second cover 10*c* to define a space to accommodate the circuit board 327 of the stator 32 and other components. The inner casing 103 and the outer casing 105 are radially spaced to define a space therebetween for accommodating the core 321, coils 325 and other components of the stator 32. Please also refer to FIGS. 6 and 10, the inner casing 103 defines a plurality of openings 107 respectively aligning with the pole portions 323 of the core 321, allowing free ends of the pole portions 323 to be embedded into the corresponding openings 107, further reducing the air gap between the stator 32 and rotor 34.

The shape and size of the inner casing 103 match the shape and size of the sleeve 50. After assembly, the inner casing 103 encircles the sleeve 50, and the two can be fixed together either by overmolding or by a tight fit. A through hole 109 is defined in a centre of a bottom side of the inner casing 103 aligning with the shaft seat 58 of the sleeve 50, allowing the shaft seat 58 to partially pass through the through hole 109 and extend into the second space 18, thereby enabling the shaft seat 58 to be closer to or directly contact the circuit board 327, further enhancing thermal conductivity. Preferably, an outer diameter of the shaft seat 58 is not less than or greater than a diameter of the through hole 105, ensuring a tight fit after assembly, which provides further fixation for the shaft seat 58 as well as the shaft sleeve 60 and shaft 40 fixed within the shaft seat 58.

A side of the pump casing body 10*a* facing the first cover 10*b* has a side plate 104 integrally connecting the inner casing 103 and the outer casing 105. Preferably, the open end 52 of the sleeve 50 extends outward radially to form a flange 56, which is stacked on the side plate 104 and axially sandwiched between the first cover 10*b* and the side plate 104. As shown in FIG. 3, preferably, a first seal ring 46 is mounted between the flange 56 and the first cover 10*b* to ensure the sealing of the first space 16, and a second seal ring 48 is mounted between the outer casing 105 and the second cover 10*c* to ensure the sealing of the second space 18. In this way, fluid leakage from the first space 16 to the outside of the fluid pump 100 can be prevented, and external environmental moisture, dust, etc., can be prevented from entering the second space 18, thus further enhancing the safety of use of the fluid pump 100.

It should be noted that the above embodiments only express the preferred embodiments of this application, and the descriptions are relatively specific and detailed, but should not be understood as a limitation on this application. It should be pointed out that for an ordinary skilled person in the field, several modifications and improvements can be made without departing from the concept of this application, such as combining different features from various embodiments, and these should all fall within the protection scope of this application.

The invention claimed is:

1. A fluid pump comprising:

a pump casing comprising a metal sleeve arranged therein and dividing an internal space of the pump casing into a first space and a second space, wherein the metal sleeve has a cylindrical structure with an open end and a closed end, and a shaft seat protrudes outward from the closed end away from the open end;

an impeller arranged in the pump casing outside the metal sleeve and faces the open end of the metal sleeve; and a motor for driving the impeller to rotate in the pump casing, the motor comprising a stator received in the second space and a rotor received in the first space, wherein the rotor is fixedly connected to the impeller and rotatably connected to a shaft, a shaft sleeve is fixedly arranged in the shaft seat of the metal sleeve, and an end of the shaft is fixedly inserted into the shaft sleeve, and the impeller is arranged on the other end of the shaft, wherein one end of the shaft sleeve is inserted into the shaft seat, and the other end of the shaft sleeve facing the impeller extends beyond the shaft seat, a positioning ring extends radially outward from the other end of the shaft sleeve to axially abut against an inner surface of the closed end of the metal sleeve.

2. The fluid pump of claim 1, wherein an outer diameter of the shaft sleeve is greater than an inner diameter of the shaft seat, the shaft sleeve is fixed to the shaft seat through a tight fit, an outer diameter of the shaft is greater than an inner diameter of the shaft sleeve, such that the shaft is fixed to the shaft sleeve through a tight fit.

3. The fluid pump of claim 1, wherein the pump casing comprises an inner casing and an outer casing spaced apart in a radial direction, and a first cover and a second cover respectively connected to both axial ends of the outer casing, the inner casing encircles the metal sleeve, the first space is defined between the metal sleeve and the first cover, and the second space is defined between the inner casing, the outer casing, and the second cover.

4. The fluid pump of claim 3, wherein a through hole is defined in a bottom side of the inner casing, the shaft seat partially passes through the through hole and extends into the second space.

5. The fluid pump of claim 4, wherein an outer diameter of the shaft seat is greater than a diameter of the through hole, such that the shaft seat and the through hole have a tight fit.

6. The fluid pump of claim 5, wherein the stator comprises a core with a plurality of pole portions, coils wound around the pole portions, and a circuit board electrically connected to the coils, the shaft seat is closer to the circuit board than the bottom side of the inner casing.

7. The fluid pump of claim 3, wherein the stator comprises a core with a plurality of pole portions, coils wound around the pole portions, and a circuit board electrically connected to the coils, the core encircles the inner casing, and the inner casing defines a plurality of openings respectively aligning with the pole portions, allowing free ends of the pole portions to be embedded into the corresponding openings.

8. The fluid pump of claim 1, wherein the metal sleeve is a stainless steel sleeve.

9. The fluid pump of claim 1, wherein the shaft sleeve is a metal shaft sleeve.

10. The fluid pump of claim 1, wherein the rotor of the motor comprises a core, permanent magnets, and a rotor shell integrally encapsulating the core and the permanent magnets, the rotor shell is integrally connected to the impeller.

11. The fluid pump of claim 10, wherein two bearings are connected between the shaft and the rotor shell.

12. The fluid pump of claim 11, wherein the bearings are integrally fixed within the rotor shell by an injection moulding process of the rotor shell.

* * * * *